US008529091B2

(12) United States Patent
Sung et al.

(10) Patent No.: US 8,529,091 B2
(45) Date of Patent: Sep. 10, 2013

(54) T-BAR LAMP

(75) Inventors: Yung-Cheng Sung, Hsinchu (TW); Chung-Pan Wu, Hsinchu (TW)

(73) Assignee: APM Communication, Inc., Hsinchu (TW)

( * ) Notice: Subject to any disclaimer, the term of this patent is extended or adjusted under 35 U.S.C. 154(b) by 0 days.

(21) Appl. No.: 13/495,974

(22) Filed: Jun. 13, 2012

(65) Prior Publication Data

US 2013/0016513 A1 Jan. 17, 2013

(30) Foreign Application Priority Data

Jul. 12, 2011 (TW) ..... 100212757 U

(51) Int. Cl.
*F21S 8/02* (2006.01)

(52) U.S. Cl.
USPC ..... 362/249.02; 362/150

(58) Field of Classification Search
USPC ..... 362/147, 148, 150, 249.02
See application file for complete search history.

(56) References Cited

U.S. PATENT DOCUMENTS

2004/0213003 A1* 10/2004 Lauderdale et al. ..... 362/404
2007/0133193 A1* 6/2007 Kim ..... 362/147
2011/0222270 A1* 9/2011 Porciatti ..... 362/147

* cited by examiner

*Primary Examiner* — David V Bruce
(74) *Attorney, Agent, or Firm* — J.C. Patents

(57) ABSTRACT

A T-bar lamp including a T-bar lamp housing and at least a light engine module is provided. The T-bar lamp housing has an opening. The light engine module is fixed in the T-BAR lamp housing, and the light engine module at least includes a chip on board (COB) type LED light source.

10 Claims, 2 Drawing Sheets

T-BAR LAMP

CROSS-REFERENCE TO RELATED APPLICATION

This application claims the priority benefit of Taiwan application serial no. 100212757, filed on Jul. 12, 2011. The entirety of the above-mentioned patent application is hereby incorporated by reference herein and made a part of this specification.

BACKGROUND OF THE INVENTION

1. Field of the Invention

The invention relates to a lamp. Particularly, the invention relates to a T-bar lamp.

2. Description of Related Art

A light-emitting diode (LED) is a semiconductor device, and a material of the LED chip thereof is mainly a compound of III-V chemical elements, for example, GaP or GaAs, and a light-emitting principle thereof is to transform electrical energy into light energy. A life span of the LED is more than 100,000 hours, and the LED has advantages of fast response speed, small size, power saving, low pollution, high reliability and suitable for mass production, etc.

Along with increasing demand for energy conservation and environmental protection, it is a world trend to use the LEDs to construct lighting lamps used in people's daily light. According to a current technique, LED bare chips or packages thereof are generally installed on a carrier (for example, a printed circuit board) to serve as lighting elements.

When the LED is applied to a T-bar lamp, a consumed power thereof is far less than that of a conventional lamp tube module, which becomes a best choice of modern commercial lighting. Therefore, the T-bar lamp using the LED light source is particularly suitable for offices and environments with a high lamp usage amount. However, regarding the T-bar lamp using the LED light source, it is uneasy to replace the LED light source when it is damaged.

SUMMARY OF THE INVENTION

The invention is directed to a T-bar lamp, in which a light-emitting diode (LED) light source is capable of being individually detached and can be conveniently replaced.

The invention provides a T-bar lamp including a T-Bar lamp housing and at least a light engine module. The T-bar lamp housing has an opening. The light engine module is fixed in the T-Bar lamp housing, and the light engine module at least includes a chip on board (COB) type LED light source.

According to an embodiment of the invention, in the T-bar lamp, the COB type LED light source includes a substrate and at least one LED chip. The LED chip is disposed on the substrate.

According to an embodiment of the invention, in the T-bar lamp, a material of the substrate is, for example, a metal material or a ceramic material.

According to an embodiment of the invention, in the T-bar lamp, the light engine module further includes a cooling module, and the COB type LED light source is disposed on the cooling module.

According to an embodiment of the invention, in the T-bar lamp, a material of the cooling module is, for example, a metal material.

According to an embodiment of the invention, in the T-bar lamp, the light engine module further includes at least one LED chip disposed on the cooling module.

According to an embodiment of the invention, the T-bar lamp further includes a diffusion plate, which is disposed on the T-bar lamp housing and covers the opening.

According to an embodiment of the invention, in the T-bar lamp, a material of the diffusion plate is, for example, polystyrene (PS), polycarbonate (PC) or polymethyl methacrylate (PMMA).

According to an embodiment of the invention, the T-bar lamp further includes a power module, which is disposed on the T-bar lamp housing and supplies power to the light engine module.

According to an embodiment of the invention, in the T-bar lamp, the power module is, for example, an alternating current (AC) to direct current (DC) transformer.

According to the above descriptions, in the T-bar lamp of the invention, since the T-bar lamp uses the COB type LED light source, the LED light source can be individually detached and can be conveniently replaced.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
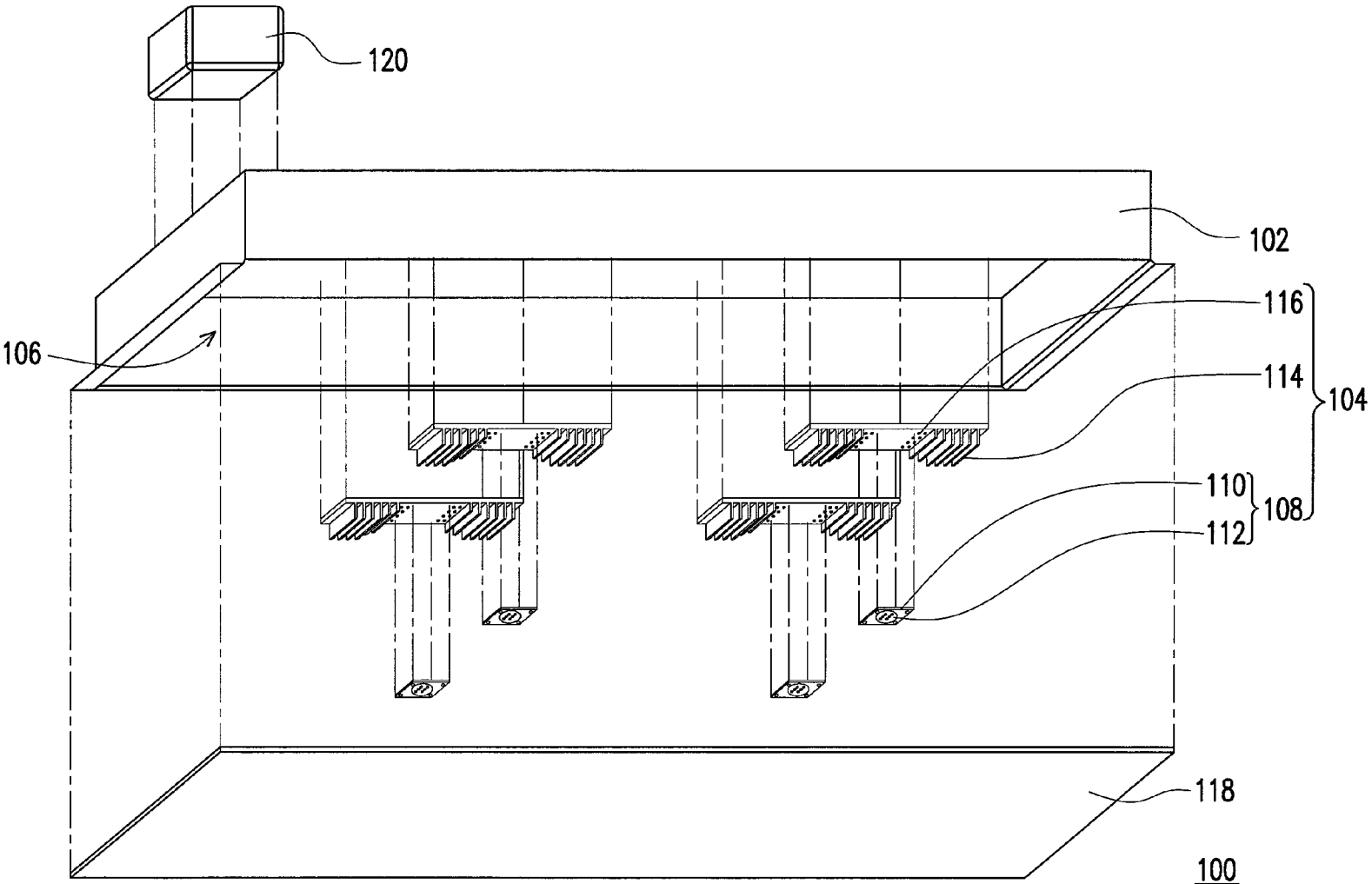
FIG. 1 is an explosion diagram of a T-bar lamp according to an embodiment of the invention.
Figure 2:
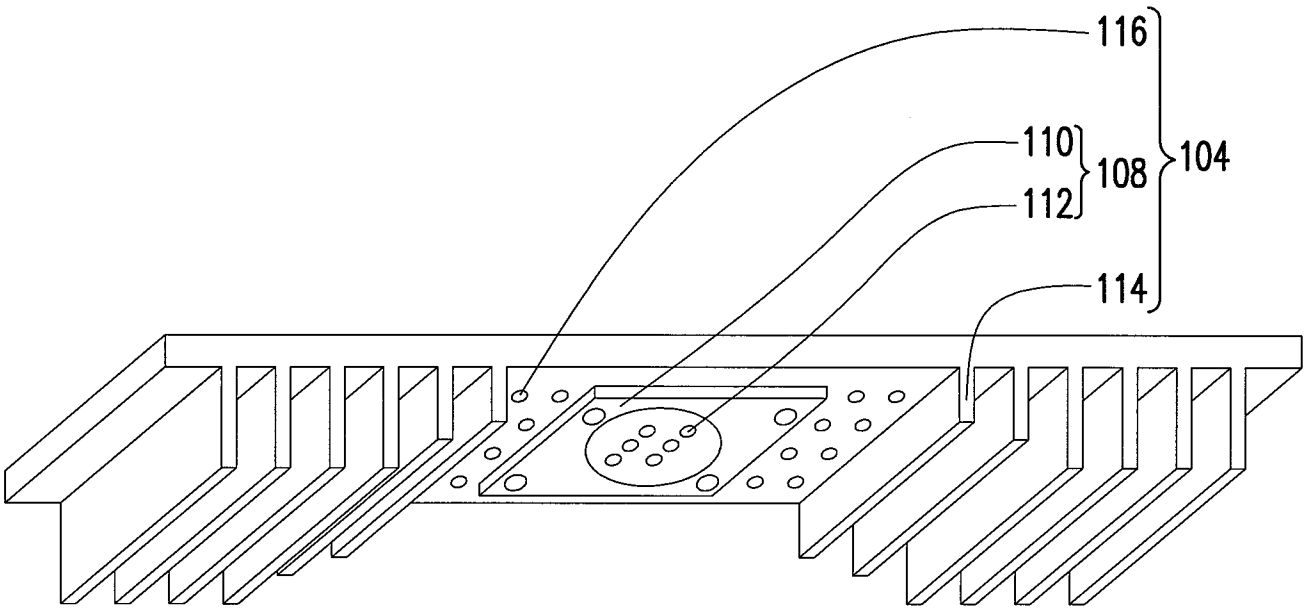
FIG. 2 is a schematic diagram of a light engine module in FIG. 1.

FIG. 1 is an explosion diagram of a T-bar lamp according to an embodiment of the invention. FIG. 2 is a schematic diagram of a light engine module in FIG. 1.

Referring to FIG. 1 and FIG. 2, the T-bar lamp 100 includes a T-Bar lamp housing 102 and light engine modules 104. The T-bar lamp housing 102 has an opening 106. A size of the T-bar lamp housing 102 is, for example, 59.5 cm×59.5 cm to 60.5 cm×60.5 cm.

The light engine modules 104 are fixed in the T-Bar lamp housing 102, and each of the light engine modules 104 at least includes a chip on board (COB) type LED light source 108. The COB type LED light source 108 can be individually replaced, which has an advantage of easy replacement. The COB type LED light source 108 includes a substrate 110 and LED chips 112. The LED chips 112 are disposed on the substrate 110. A material of the substrate 110 is, for example, a metal material or a ceramic material.

Moreover, the light engine module 104 may selectively include a cooling module 114. The COB type LED light source 108 is disposed on the cooling module 114, which avails cooling the COB type LED light source 108. A material of the cooling module 114 is, for example, a metal material. When the light engine module 104 is formed by disposing the COB type LED light source 108 on the cooling module 114, a user can easily replace the light engine module 104. In another embodiment, when the light engine module 104 does not have the cooling module 114, the COB type LED light source 108 used as the light engine module 104 is directly fixed in the T-bar lamp housing 102.

Moreover, the light engine module 104 may selectively include LED chips 116. The LED chips 116 are disposed on the cooling module 114, which avails increasing an overall illumination brightness of the light engine module 104.

In the present embodiment, the number of the light engine modules 104, the number of the LED chips 112 on one COB type LED light source 108 and the number of the LED chips 116 on one light engine module 104 are, for example, respectively 4, 6 and 16 (due to a viewing angle's sake, a part of the LED chips 116 in FIG. 1 and FIG. 2 are shielded by the cooling module 114), though the invention is not limited thereto, and as long as the number of the light engine module 104, the number of the LED chip 112 on one COB type LED light source 108 and the number of the LED chip 116 on one light engine module 104 are respectively one or more, it is considered to be within a protection scope of the invention. Those skilled in the art can adjust the number of the light engine modules 104, the number of the LED chip 112 and the number of the LED chip 116 according to an actual design requirement.

On the other hand, the T-bar lamp 100 may selectively include at least one of a diffusion plate 118 and a power module 120. The diffusion plate 118 is disposed on the T-bar lamp housing 102 and covers the opening 106, which avails avoiding generation of glare. A material of the diffusion plate 118 is, for example, polystyrene (PS), polycarbonate (PC) or polymethyl methacrylate (PMMA). The power module 120 is disposed on the T-bar lamp housing 102, and supplies power to the light engine module 104. The power module 120 is, for example, an alternating current (AC) to direct current (DC) transformer.

According to the above embodiment, it is known that since the T-bar lamp 100 uses the COB type LED light source 108, the LED light source can be individually detached and can be conveniently replaced. Moreover, when the light engine module 104 is formed by disposing the COB type LED light source 108 on the cooling module 114, the user can easily replace the light engine module 104.

In summary, the aforementioned embodiment has at least following advantages:

1. The T-bar lamp of the invention has an individually detachable LED light source.
2. By using the T-bar lamp of the invention, the LED light source can be conveniently replaced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A T-bar lamp, comprising:

a T-Bar lamp housing, having an opening; and at least a light engine module, fixed in the T-Bar lamp housing, and at least comprising a chip on board (COB) type light-emitting diode (LED) light source.

2. The T-bar lamp as claimed in claim 1, wherein the COB type LED light source comprises:

a substrate; and at least one LED chip, disposed on the substrate.

3. The T-bar lamp as claimed in claim 2, wherein a material of the substrate comprises a metal material or a ceramic material.

4. The T-bar lamp as claimed in claim 1, wherein the light engine module further comprises a cooling module, and the COB type LED light source is disposed on the cooling module.

5. The T-bar lamp as claimed in claim 4, wherein a material of the cooling module comprises a metal material.

6. The T-bar lamp as claimed in claim 4, wherein the light engine module further comprises at least one LED chip disposed on the cooling module.

7. The T-bar lamp as claimed in claim 1, further comprising a diffusion plate, disposed on the T-bar lamp housing and covering the opening.

8. The T-bar lamp as claimed in claim 7, wherein a material of the diffusion plate comprises polystyrene (PS), polycarbonate (PC) or polymethyl methacrylate (PMMA).

9. The T-bar lamp as claimed in claim 1, further comprising a power module, disposed on the T-bar lamp housing and supplying power to the light engine module.

10. The T-bar lamp as claimed in claim 9, wherein the power module comprises an alternating current (AC) to direct current (DC) transformer.

* * * * *